US006646051B1

(12) United States Patent
Demain

(10) Patent No.: US 6,646,051 B1
(45) Date of Patent: Nov. 11, 2003

(54) POLYPROPYLENE FIBRES

(75) Inventor: Axel Demain, Tourinnes-Saint-Lambert (BE)

(73) Assignee: Atofina Research, Feluy (BE)

( * ) Notice: Subject to any disclaimer, the term of this patent is extended or adjusted under 35 U.S.C. 154(b) by 0 days.

(21) Appl. No.: 09/937,426

(22) PCT Filed: Mar. 28, 2000

(86) PCT No.: PCT/EP00/02877

§ 371 (c)(1),
(2), (4) Date: Jan. 24, 2002

(87) PCT Pub. No.: WO00/60148

PCT Pub. Date: Oct. 12, 2000

(30) Foreign Application Priority Data

Mar. 30, 1999 (EP) ..... 99106460

(51) Int. Cl.[7] ..... D01F 6/46; C08L 23/00; C08L 23/04

(52) U.S. Cl. ..... 525/191; 525/240; 526/290; 526/351

(58) Field of Search ..... 526/290, 351; 525/191, 240

(56) References Cited

U.S. PATENT DOCUMENTS 4,794,096 A 12/1988 Ewen
5,269,807 A 12/1993 Liu
5,455,305 A * 10/1995 Galambos ..... 525/240
6,444,774 B1 * 9/2002 Stahl et al. ..... 526/351

FOREIGN PATENT DOCUMENTS

| | | |
|---|---|---|
| EP | 0284707 A2 | 10/1988 |
| EP | 0414047 A2 | 2/1991 |
| EP | 0427696 A2 | 5/1991 |
| EP | 0451743 A2 | 10/1991 |
| EP | 0634505 A1 | 1/1995 |
| EP | 0789096 A1 | 8/1997 |
| EP | 0832924 A2 | 4/1998 |
| EP | 0870779 A1 | 10/1998 |
| EP | 0894875 A2 | 2/1999 |
| WO | WO 9623095 | 8/1996 |
| WO | WO 9710300 | 3/1997 |

* cited by examiner

*Primary Examiner*—Nathan M. Nutter
(74) *Attorney, Agent, or Firm*—William D. Jackson

(57) ABSTRACT

A polypropylene fibre including a polypropylene blend comprising up to 15% by weight of sPP at least 10% by weight of a first isotactic polypropylene produced by a metallocene catalyst, and optionally a second isotactic polypropylene produced by a Ziegler-Natta catalyst.

22 Claims, No Drawings

POLYPROPYLENE FIBRES

FIELD OF THE INVENTION

The present invention relates to polypropylene fibres and to fabrics produced from polypropylene fibres.

DESCRIPTION OF RELATED ART

Polypropylene is well known for the manufacture of fibres, particularly for manufacturing non woven fabrics.

EP-A-0789096 discloses such polypropylene fibres which are made of a blend of syndiotactic polypropylene (sPP) and isotactic polypropylene (iPP). That specification discloses that by blending from 0.3 to 3% by weight of sPP, based on the total polypropylene, to form a blend of iPP-sPP, the fibres have increased natural bulk and smoothness, and non-woven fabrics produced from the fibres have an improved softness. Moreover, that specification discloses that such a blend lowers the thermal bonding temperature of the fibres. Thermal bonding is employed to produce the non-woven fabrics from the polypropylene fibres.

The specification discloses that the isotactic polypropylene comprises a homopolymer formed by the polymerisation of propylene by Ziegler-Natta catalysis. The isotactic polypropylene typically has a weight average molecular weight Mw of from 100,000 to 4,000,000 and a number average molecular weight Mn of from 40,000 to 100,000, with a melting point of from about 159 to 169° C. However, the polypropylene fibres produced in accordance with this specification suffer from the technical problem that the isotactic polypropylene, being made using a Ziegler-Natta catalyst, does not have particularly high mechanical properties, particularly tenacity.

WO-A-96/23095 discloses a method for providing a non-woven fabric with a wide bonding window in which the non-woven fabric is formed from fibres of a thermoplastic polymer blend including from 0.5 to 25 wt % of syndiotactic polypropylene. The syndiotactic polypropylene may be blended with a variety of different polymers, including isotactic polypropylene. The specification includes a number of examples in which various mixtures of syndiotactic polypropylene with isotactic polypropylene were produced. The isotactic polypropylene comprised commercially available isotactic polypropylene, which is produced using a Ziegler-Natta catalyst. It is disclosed in the specification that the use of syndiotactic polypropylene widens the window of temperature over which thermal bonding can occur, and lowers the acceptable bonding temperature.

WO-A-96/23095 also discloses the production of fibres from blends including syndiotactic polypropylene which are either bi-component fibres or bi-constituent fibres. Bi-component fibres are fibres which have been produced from at least two polymers extruded from separate extruders and spun together to form one fibre. Bi-constituent fibres are produced from at least two polymers extruded from the same extruder as a blend. Both bi-component and bi-constituent fibres are disclosed as being used to improve the thermal bonding of Ziegler-Natta polypropylene in non-woven fabrics. In particular, a polymer with a lower melting point compared to the Ziegler-Natta isotactic polypropylene, for example polyethylene, random copolymers or terpolymers, is used as the outer part of the bi-component fibre or blended in the Ziegler-Natta polypropylene to form the bi-constituent fibre.

EP-A-0634505 discloses improved propylene polymer yarn and articles made therefrom in which for providing yarn capable of increased shrinkage syndiotactic polypropylene is blended with isotactic polypropylene with there being from 5 to 50 parts per weight of syndiotactic polypropylene. It is disclosed that the yarn has increased resiliency and shrinkage, particularly useful in pile fabric and carpeting. It is disclosed that the polypropylene blends display a lowering of the heat softening temperature and a broadening of the thermal response curve as measured by differential scanning calorimetry as a consequence of the presence of syndiotactic polypropylene.

U.S. Pat. No. 5,269,807 discloses a suture fabricated from syndiotactic polypropylene exhibiting a greater flexibility than a comparable suture manufactured from isotactic polypropylene. The syndiotactic polypropylene may be blended with, inter alia, isotactic polypropylene.

EP-A-0451743 discloses a method for moulding syndiotactic polypropylene in which the syndiotactic polypropylene may be blended with a small amount of a polypropylene having a substantially isotactic structure. It is disclosed that fibres may be formed from the polypropylene. It is also disclosed that the isotactic polypropylene is manufactured by the use of a catalyst comprising titanium trichloride and an organoaluminium compound, or titanium trichloride or titanium tetrachloride supported on magnesium halide and an organoaluminium compound, i.e. a Ziegler-Natta catalyst.

EP-A-0414047 discloses polypropylene fibres formed of blends of syndiotactic and isotactic polypropylene. The blend includes at least 50 parts by weight of the syndiotactic polypropylene and at most 50 parts by weight of the isotactic polypropylene. It is disclosed that the extrudability of the fibres is improved and the fibre stretching conditions are broadened.

EP-A-0894875 discloses bicomponent fibres of isotactic and syndiotactic polypropylene in which an isotactic polypropylene component and a syndiotactic polypropylene component are each fused to the other along the fibre axis. This specification does not address the problem of the manufacture of non-woven fabrics by thermal bonding.

EP-A-0832924 relates to a polyolefin moulding composition for producing high strength non-woven fabric.

WO-A-97/10300 discloses polypropylene blend compositions comprising propylene copolymer having a broad molecular weight distribution. The first and second propylene polymers of the blend are preferably isotactic.

EP-A-0870779 discloses a metallocene catalyst system for producing a polypropylene blend of iso- and syndiotactic polypropylene.

EP-A-0284707 discloses a hafnium metallocene catalyst for the polymerisation of olefins, in particular to make isotactic polypropylene.

EP-A-0427696 discloses a process and catalyst for producing syndiotactic polymers, in particular syndiotactic polypropylene using metallocene catalysts.

It is further known to produce syndiotactic polypropylene using metallocene catalysts as has been disclosed for example in U.S. Pat. No. 4,794,096.

Recently, metallocene catalysts have also been employed to produce isotactic polypropylene. Isotactic polypropylene which has been produced using a metallocene catalyst is identified hereinafter as miPP. Fibres made of miPP exhibit much higher mechanical properties, mainly tenacity, than typical Ziegler-Natta polypropylene based fibres, hereinafter referred to as znPP fibres. However, this gain in tenacity is only partly transferred to non-woven fabrics which have been produced from the miPP fibres by thermal bonding. Indeed, fibres produced using miPP have a very narrow thermal bonding window, the window defining a range of thermal bonding temperatures through which, after thermal bonding of the fibres, the non-woven fabric exhibits the best mechanical properties. As a result, only a small number of the miPP fibres contribute to the mechanical properties of the non-woven fabric. Also, the quality of the thermal bond between adjacent miPP fibres is poor. Thus known miPP fibres have been found to be more difficult to thermally bond than znPP fibres, despite a lower melting point.

SUMMARY OF THE INVENTION

It is an aim of the present invention to broaden the thermal bonding window of miPP fibres. It is a further aim of the invention to provide non-woven fabrics of miPP fibres exhibiting improved mechanical properties, in particular tenacity.

It is known that polypropylene fibres, and non-woven fabrics made of polypropylene fibres, tend to feel rough to the touch. It is also an aim of the present invention to improve the softness of miPP polypropylene fibres.

The present invention provides a polypropylene fibre including a polypropylene blend comprising up to 15% by weight of sPP, at least 10% by weight of a first isotactic polypropylene produced by a metallocene catalyst, and optionally a second isotactic polypropylene produced by a Ziegler-Natta catalyst.

Preferably, the sPP concentration in the sPP/miPP blend is from 3 to 15 wt %. The fibre may be a two component sPP/miPP blend, including at least 85 wt % miPP. When present, the znPP may be a homopolymer, copolymer or terpolymer.

Preferably, the miPP is a homopolymer, copolymer, being either a random or block copolymer, or terpolymer of isotactic polypropylene produced by a metallocene catalyst.

Preferably, the first polypropylene has a dispersion index (D) of from 2 to 3.5. Preferably, the first polypropylene has a melting temperature in the range of from 140 to 155° C. for homopolymer and a melting temperature of from 80 to 150° C. for a copolymer or terpolymer.

The miPP preferably has a melt flow index (MFI) of from 1 to 2500 g/10 mins. In this specification the MFI values are those determined using the procedure of ISO 1133 using a load of 2.16 kg at a temperature of 230° C.

More preferably, the first polypropylene homopolymer has an Mn of from 50,000 to 100,000 kDa and the MFI may range from 15 to 90 g/10 min for spunlaid or staple fibres. The MFI may range from 350 to 2500 g/10 min for the first polypropylene being a copolymer or a terpolymer having a higher Mn than for the homopolymer for making melt blown fibres.

The sPP is preferably a homopolymer or a random copolymer with a comonomer content of from 0.1 to 1.5 wt %. The sPP may alternatively be a block copolymer having a higher comonomer content, or a terpolymer. If the comonomer content is above 1.5 wt %, the sPP tends to become sticky, thus resulting in problems when spinning the fibres or thermally bonding the fibres. The comonomer content is selected so as to decrease the melting point of the sPP iPP blend below 130° C. A lower melting point can also be obtained by using particular catalysts and/or process conditions during polymerisation of the sPP. Preferably, the sPP has a melting temperature of up to about 130° C. The sPP typically has two melting peaks, one being around 112° C. and the other being around 128° C. The sPP typically has an MFI of from 0.1 to 1000 g/10 min, more typically from 1 to 60g/10 min. The sPP may have a monomodal or multimodal molecular weight distribution, and most preferably is a bimodal polymer in order to improve the processability of the sPP. The properties of a typical bimodal sPP for use with the invention are specified in Table 1.

The present invention further provides a polypropylene fibre including a polypropylene blend comprising up to 15% by weight of sPP, at, least 10% by weight of a first isotactic polypropylene homopolymer, copolymer or terpolymer having a melting temperature of from 80° C. to 155° C., and optionally a second isotactic polypropylene homopolymer or copolymer having a melting temperature of from 159° C. to 169° C.

Preferably, the first isotactic polypropylene has a dispersion index (D) of from 2 to 3.5.

Preferably, the second isotactic polypropylene has a dispersion index (D) of from 3 to 9.

The present invention further provides a fabric produced from the polypropylene fibre of the invention.

The present invention yet further provides a product including that fabric, the product being selected from among others a filter, personal wipe, diaper, feminine hygiene product, incontinence product, wound dressing, bandage, surgical gown, surgical drape and protective cover.

DETAILED DESCRIPTION OF THE INVENTION

The present invention is predicated on the discovery by the present inventor that when blended with miPP, even in small concentrations, sPP is rejected to the surface of the polypropylene fibres during the spinning process. Accordingly, when blending miPP, which has a typical melting range of from around 140C to around 155° C., with sPP, which typically has a melting range of from about 80° C. to about 130° C., even though only a small concentration of sPP is incorporated into the miPP, as a result of the rejection of the sPP to the surface of the fibres, the range of temperature through which the fibres can be thermally bonded, is broadened and shifted to lower temperatures. As a consequence, at any given thermal bonding temperature, more fibres are thermally bonded and bonding strength improves, thereby improving the mechanical properties of the non-woven fabric produced thereby.

Since the sPP has a melting peak about 15° C. lower than that of the miPP and is rejected to the surface of the fibres during the spinning process, as a consequence when thermally bonding the fibres at a lower temperature than the optimal thermal bonding temperature for pure miPP fibres, the sPP contributes to improving the strength of the thermally bonded points, hence broadening the thermal bonding window.

The present inventor has found that when used in an amount of only about 2 to 3 wt % sPP in the sPP/miPP blend, the thermal bondability is increased, as a result of the sPP being rejected to the surface of the fibres during the spinning process. The known Ziegler-Natta isotactic polypropylene fibres, such as those disclosed in the patent specifications identified hereinabove, typically have a melting temperature of around 159–169° C., for example 162° C. The difference in temperature between the known Ziegler-Natta isotactic polypropylene fibres and the sPP incorporated therein in the patent specifications referred to hereinabove has provided improved properties. However, for miPP utilised in accordance with the present invention, the typical melting point is around 140° C. to 155° C., which is typically around 15° C. to 20° C. higher than that for the sPP, but also significantly lower than that of the Ziegler-Natta isotactic polypropylene.

Comonomer addition into the sPP allows the melting point to decrease. As a consequence, comonomer concentration may be adjusted to reach the desired melting temperature, whereby the miPP and the sPP have a melting peak difference of about 15° C. to 20° C. The combination of the relatively low melting peak difference between on the one hand the miPP and on the other hand the sPP and also the provision of the sPP on the surface of the fibres following the spinning process provides significant advantages when the fibres are employed to make thermally bonded non-woven fabrics. An industrial thermal bonding process for producing a non-woven fabric employs the passage at high speed of a layer of fibres to be thermally bonded through a pair of heated rollers. This process thus requires rapid and uniform melting of the surfaces of adjacent fibres in order for a strong and reliable thermal bond to be achieved. The addition of sPP to the miPP lowers the thermal bonding temperature of the fibres and broadens the thermal bonding temperature range or "window" for the fibres, thus increasing the ease of thermal bonding the fibres together. Since the sPP tends to be at the surface of the fibres and since the miPP has a melting point range which is only slightly higher than that of the sPP so that there is a melting temperature overlap between the sPP and the miPP in the thermal bonding temperature window, when the fibres are thermally bonded, which can be achieved at lower-temperatures than for miPP alone, the increased breadth of the thermal bonding window can provide that not only is the sPP on the surface of the fibres melted, but also some of the miPP tends to be melted, to form bonds between adjacent fibres. Thus the incorporation of sPP into miPP enables the maximum strength of the non-woven fabric to be greatly increased as a result of this increased thermal bond formation between adjacent fibres.

In contrast, znPP has a significantly higher melting point range than that for sPP so that when the known znPP/sPP fibres are thermally bonded, the thermal bonding, and thus the tenacity are lower than for the miPP/sPP blends of the invention because the znPP does not contribute to the formation of thermal bonds.

The miPP employed in accordance with the invention has a narrow molecular weight distribution, typically having a dispersion index D of from 2 to 3.5, more preferably from 2 to 3. The dispersion index D is the ratio Mw/Mn, where Mw is the weight number average molecular weight and Mn is the number average molecular weight of the polymer. The miPP typically has a peak in the molecular weight distribution of 60,000 to 120,000 kDa. The miPP has a melting temperature in the range of from 140° C. to 155° C. The properties of two typical miPP resins for use in the invention are specified in Table 1.

In contrast, the sPP has a slightly broader molecular weight distribution than for the miPP, wherein typically D may be around 4 and has a peak of the molecular weight distribution at around 20,000 to 40,000 kDa. The sPP has a melting temperature of up to about 130° C. In view of the separation between the peaks and the substantial non-overlap of the molecular weight distributions of the sPP and the miPP, it is surprising that those two components can in fact readily be blended together. The sPP tends to be provided at the surface of the miPP fibres. As stated above, this provides an advantage in thermal bonding. Since there is an overlap in the melting point range in the miPP and the sPP, there is an increase in thermal bonding between the fibres, and this increase is manifested in an increase tenacity for non-woven fabrics produced in accordance with the invention, with tenacity increasing with an increase in the amount of sPP. This is because any increase in sPP tends to be increase the amount of material thermally bonded on the surface of the fibres. However, for sPP amounts greater than about 15 to 20 wt %, the amount varying depending upon other parameters, such as the particular processing conditions for spinning the fibres, the tenacity can tend to decrease.

The addition of sPP to the miPP also has been found by the inventor to improve the softness of the fibres. As a result of this surface rejection phenomenon, the inventor has found that the softness of the fibres may be increased using only small amounts of sPP, for example from 0.3 wt % sPP in the sPP/miPP blend. Since the blending of sPP into miPP permits a lower thermal bonding temperature to be employed than would be employed for pure miPP fibres, and since lower thermal bonding temperatures tend to reduce the roughness to the touch of a non-woven fabric produced from the fibres, introducing sPP in accordance with the invention into miPP improves the softness of the non-woven fabric.

Furthermore, in accordance with the invention when sPP is incorporated into miPP to form blends thereof, and when those blends are used to produce spun fibres, the sPP promotes fibres having improved natural bulk, resulting in improved softness of the non-woven fabric.

In addition, the use of miPP in blends with sPP in accordance with the invention tends to provide fibres which can be more readily spun as compared to known znPP fibres. The substantial absence of such long chains in the molecular weight distribution of the miPP tends to reduce built-in stress during spinning thereby to allow in an increase in the maximum spin speed for the fibres of the sPP/miPP blends in accordance with the invention.

In accordance with the invention, the incorporation of sPP into miPP to form blends thereof provides a broader thermal bonding window, allowing transfer of the properties of the miPP fibres into the properties of the non-woven fabrics produced from the blends. The thermal bonding temperature of fibres produced from such blends is also slightly lower. The fibres and non-woven fabrics produced from the blends have increased softness and the spun fibres have natural bulk as a result of the introduction of sPP into the miPP. The fibres also have improved resiliency compared to known polypropylene znPP fibres as a result of the use of sPP. Furthermore, the use of miPP allows the production of finer fibres, resulting in softer fibres and a more homogeneous distribution of the fibres in the non-woven fabric.

Although it was known prior to the present invention to use a second polymer in fibres, it has not heretofore been proposed to employ sPP in a blend with miPP for the production of fibres. The use of sPP provides optimum thermal characteristics that help improve the thermal bonding of the miPP fibres. Efficient thermal bonding of the fibres is required to transfer the outstanding mechanical properties of miPP fibres into non-woven fabrics. In addition, only a few percent of sPP is enough to observe a significant improvement in the mechanical properties such as thermal bondability and softness of the fibres and non-woven fabrics, whereas with other polymers much larger quantities are required. As a consequence, the spinnability of the fibres produced using sPP/miPP blends in accordance with the invention is not significantly modified as compared to known fibres.

The fibres produced in accordance with the invention may be either bi-component fibres or bi-constituent fibres. For bi-component fibres, miPP and sPP are fed into two different extruders. Thereafter the two extrudates are spun together to form single fibres. For the bi-constituent fibres, blends of sPP/miPP are obtained by: dry blending pellets, flakes or fluff of the two polymers before feeding them into a common extruder; or using pellets or flakes of a blend of sPP and miPP which have been extruded together and then re-extruding the blend from a second extruder.

When the blends of sPP/miPP are used to produce fibres in accordance with the invention, at up to 15 wt % sPP there is no significant effect on the spinning characteristics of the blends. For the production of spunlaid fibres, a typical extrusion temperature would be in the range of from 200° C. to 260° C., most typically from 230° C. to 250° C. For the production of staple fibres, a typical extrusion temperature would be in the range of from 230° C. to 330° C., most typically from 280° C. to 300° C.

The fibres produced in accordance with the invention may be produced from sPP/miPP blends having other additives to improve the mechanical processing or spinnability of the fibres. The fibres produced in accordance with the invention may be used to produce non-woven fabrics for use in filtration; in personal care products such as wipers, diapers, feminine hygiene products and incontinence products; in medical products such as wound dressings, surgical gowns, bandages and surgical drapes; in protective covers; in outdoor fabrics and in geotextiles. Non-woven fabrics made with the sPP/miPP fibres of the invention can be part of such products, or constitute entirely the products. As well as making non-woven fabrics, the fibres may also be employed to make a knitted fabric or a mat. The non-woven fabrics produced from the fibres in accordance with the invention can be produced by several processes, such as air through blowing, melt blowing, spun bonding or bonded carded processes. The fibres of the invention may also be formed as a non-woven spunlace- product which is formed without thermal bonding by fibres being entangled together to form a fabric by the application of a high pressure-fluid such as air or water.

The present invention will now be described in greater detail with reference to the following non-limiting examples.

EXAMPLES 1 AND 2 AND COMPARATIVE EXAMPLE 1

A non-woven fabric made using fibres of a polypropylene produced using a Ziegler-Natta catalyst and having a weight of 17 g/m$^2$ was tested to determine its tenacity in accordance with Comparative Example 1. In accordance with Examples 1 and 2, two isotactic polypropylenes produced using a metallocene catalyst and having respectively 1 and 5 wt % sPP blended in the miPP, the non-woven fabrics also having a weight of 17 g/m$^2$, were also tested for their tenacity. The non-woven fabrics were all spun laid. For each of the three non-woven fabrics, the force at break in the machine direction and the force at break in the transverse direction were measured and the results are shown in Table 2.

Also shown in Table 2 is an indication of the bonding index, which is a measure of the average properties of a non-woven fabric and is calculated as the square root of the force at break in the machine direction multiplied by the force at break in the transverse direction. The bonding index is normalised to a value of the weight of the non-woven fabric.

It may be seen that for both the non-woven fabrics in accordance with Examples 1 and 2, the force at break in both the machine direction and in the transverse direction was higher than for the non-woven fabric produced from the Ziegler-Natta polypropylene fibres of Comparative Example 1. The bonding index is thus also higher for Examples 1 and 2 as compared to Comparative Example 1. It may also be seen that as the amount of the sPP in the blend of miPP/sPP increases from 1% to 5% by weight going from Example 1 to Example 2, the force at break both in the machine direction and in the transverse direction, and also the bonding index, increase. This shows that the tenacity of the non-woven fabric increases with increase in the amount of sPP in the blend.

COMPARATIVE EXAMPLES 2 to 5

In Comparative Examples 2 and 4, non-woven fabrics composed of isotactic polypropylene fibres produced using a Ziegler-Natta catalyst and having respective weights of 18 and 86 g/m$^2$ were tested to determine their tenacity by measuring the force at break in the machine direction of the non-woven fabric. The results are shown in Table 3. For Comparative Examples 3 and 5, sPP was blended into the iPP to form a 95 iPP/5 sPP blend by weight and two non-woven fabrics were produced from fibres of those blends, the non-woven fabrics of Comparative Examples 3 and 5 having the same weights of 18 g/m$^2$ and 86 g/m$^2$ as Comparative Examples 2 and 4 respectively. Again, those non-woven fabrics were tested for their tenacity and the results are shown in Table 3.

It may be seen from Table 3 that for each of the two different fabric weights, the blending of sPP into the Ziegler-Natta iPP did not tend to increase the force at break, representing the tenacity, of the thermally bonded non-woven fabric.

The addition of sPP to znPP in accordance with the Comparative Examples thus tends not to increase the maximum force at break which is achievable by non-woven fabrics thermally bonded from such fibres. However, as recognised in the prior art the addition of sPP to znPP does tend to reduce the thermal bonding temperature of the fibres, and also broadens the thermal bonding temperature window. However, the reduction in the bonding temperature and the increase in the breadth of the window, while increasing the ease of bonding, does not lead to an increase in the maximum achievable thermal bond strength by adding sPP to znPP. Rather, the addition of sPP to znPP merely shifts the bonding temperature at which the maximum strength is achieved, not the total maximum strength value itself, as evidenced by Comparative Examples 2 to 5.

TABLE 1

| | | sPP | miPP1 | miPP2 |
|---|---|---|---|---|
| $MI_2$ | | 3.6 | 32 | 15 |
| Tm | ° C. | 110 and 127 | 148.7 | 143.7 |
| Mn | kDa | 37426 | 54776 | 68556 |
| Mw | kDa | 160229 | 137423 | 186430 |
| Mz | kDa | 460875 | 242959 | 400210 |
| Mp | kDa | 50516 | 118926 | 134554 |
| D | | 4.3 | 2.5 | 2.7 |

TABLE 2

| | Comparative Example 1 | Example 1 | Example 2 |
|---|---|---|---|
| Property | Ziegler-Natta PP | miPP-1% sPP | miPP-5% sPP |
| Force at break in machine direction (MD) (g/50 mm) | 3050 | 3245 | 3930 |
| Force at break in transverse direction (TD (g/50 mm) | 2783 | 3523 | 3353 |
| Bonding Index | 2919 | 3381 | 3630 |

TABLE 3

| | Comparative Example 2 | Comparative Example 3 | Comparative Example 4 | Comparative Example 5 |
|---|---|---|---|---|
| Non-woven Composition | iPP | iPP/sPP (95/5) | iPP | iPP/sPP (95/5) |
| Weight | 18 g/m$^2$ | 18 g/m$^2$ | 86 g/m$^2$ | 86 g/m$^2$ |
| Max. Force (N) (MD) | 21 | 21 | 68 | 66 |

What is claimed is:

1. A polypropylene fibre including propylene blend comprising a syndiotactic polypropylene in an amount of up to 15% by weight and at least 10% by weight of a first isotactic polypropylene having a melting temperature of from 80° C. to 155° C., and optionally a second isotactic polypropylene having a melting temperature of from 159° C. to 169° C. wherein the first isotactic polypropylene has a dispersion index (D) of from 2 to 3.5.

2. A polypropylene fibre according to claim 1 containing the second isotactic polypropylene having a dispersion index (D) of from 3 to 9.

3. A polypropylene fibre comprising a blend of a syndiotactic polypropylene (sPP) and an isotactic polypropylene (miPP) produced by a metallocene catalyst, said sPP being present in said polypropylene blend in an amount of up to 15% by weight and said isotactic polypropylene being present in said blend in an amount of at least 10% by weight.

4. A polypropylene fibre according to claim 3 wherein the sPP concentration in the blend is from 3 to 15 wt %.

5. A polypropylene fibre according to claim 4 wherein the isotactic polypropylene miPP has a dispersion index (D) of from 2 to 3.5.

6. A polypropylene fibre according to claim 5 wherein the isotactic polypropylene miPP has a melting temperature in the range of from 80 to 155° C.

7. A polypropylene fibre according to claim 3 wherein the isotactic polypropylene miPP-has a melt flow index (MFI) of from 1 to 2500 g/10 mins.

8. A polypropylene fibre according to claim 7 wherein the sPP has a melting temperature of up to about 130° C.

9. A polypropylene fibre according to claim 3 wherein the sPP has an MFI of from 0.1 to 1000 g/10 min.

10. A polypropylene fibre according to claim 9 wherein the sPP has an MFI of from 1 to 60 g/10 min.

11. A polypropylene fibre according to claim 3 wherein the sPP has a monomodal or multimodal molecular weight distribution.

12. A polypropylene fibre according to claim 3 wherein the sPP is preferentially located at the surface of said fibre.

13. A polypropylene fibre according to claim 3 which is produced by a spinning process in which the sPP is rejected to the surface of the fibre.

14. A polypropylene fibre according to claim 3 wherein the sPP is present in an amount of at least 0.3 wt %.

15. A polypropylene fibre according to claim 3 containing from about 2 to about 3 wt % sPP.

16. A polypropylene fibre according to claim 3 further comprising a second isotactic polypropylene produced (znPP) by a Ziegler-Natta catalyst.

17. A polypropylene fibre according to claim 16 wherein the sPP has a melting peak which is at least about 15° C. lower than that of the miPP.

18. A polypropylene fibre comprising a polypropylene blend of a syndiotactic polypropylene (sPP) in an amount of up to 15% by weight and at least 10% by weight of a first isotactic (miPP) polypropylene produced by a metallocene catalyst having a melting temperature of from 80° C. to 155° C., and optionally a second isotactic polypropylene (znPP) produced by a Ziegler-Natta catalyst and having a melting temperature of from 159° C. to 169° C.

19. A polypropylene fibre according to claim 18 wherein the sPP is preferentially located at the surface of said fibre.

20. A polypropylene fibre according to claim 19 further comprising said second isotactic polypropylene (znPP) which has a dispersion index of from 3 to 9.

21. A fabric produced from the polypropylene fibre according to claim 18.

22. A product including a fabric according to claim 21, the product being selected from a filter, personal wipe, diaper, feminine hygiene product, incontinence product, wound dressing, bandage, surgical gown, and surgical drape.

* * * * *

UNITED STATES PATENT AND TRADEMARK OFFICE

CERTIFICATE OF CORRECTION

PATENT NO. : 6,646,051 B1
DATED : November 11, 2003
INVENTOR(S) : Axel Demain

It is certified that error appears in the above-identified patent and that said Letters Patent is hereby corrected as shown below:

Column 9,
Line 27, replace “including propylene” with -- including a polypropylene --.

Signed and Sealed this

Twenty-seventh Day of July, 2004

JON W. DUDAS
*Acting Director of the United States Patent and Trademark Office*